United States Patent [19]

Armbruster et al.

[11] Patent Number: 4,943,687

[45] Date of Patent: Jul. 24, 1990

[54] CURRENT COLLECTING UNIT

[75] Inventors: Franz Armbruster; Carsten Bauer, both of Stuttgart; Friedhelm Meyer, Illingen, all of Fed. Rep. of Germany

[73] Assignee: Robert Bosch GmbH, Stuttgart, Fed. Rep. of Germany

[21] Appl. No.: 289,199

[22] Filed: Dec. 23, 1988

[30] Foreign Application Priority Data

Jan. 14, 1988 [DE] Fed. Rep. of Germany ... 8800341[U]

[51] Int. Cl.[5] ..... H01R 4/02

[52] U.S. Cl. ..... 174/94 R; 219/56.1; 219/85.14; 219/85.18; 403/271; 439/874

[58] Field of Search ..... 174/94 R; 403/270, 271, 403/272; 219/56.1, 56.22, 85.14, 85.18; 338/329; 439/874

[56] References Cited

U.S. PATENT DOCUMENTS

| | | | |
|---|---|---|---|
| 1,819,554 | 8/1931 | Hanson | 174/94 R |
| 2,250,156 | 7/1941 | Ferguson | 439/874 X |
| 2,560,678 | 7/1951 | Wirt | 219/56.22 |
| 3,248,681 | 4/1966 | Reintgen | 174/94 R |
| 3,781,981 | 1/1974 | Miura etal. | 219/56.1 |
| 4,034,152 | 7/1977 | Warner | 439/874 X |
| 4,471,160 | 9/1984 | Arthur | 174/94 R |

*Primary Examiner*—Morris H. Nimmo

*Attorney, Agent, or Firm*—Michael J. Striker

[57] ABSTRACT

A current collecting unit comprises a current collecting rail having a longitudinal axis and provided with a sleeve, and a connecting member mounted in the sleeve having one curved portion located above the longitudinal axis and another curved portion located below the longitudinal axis and both forming electrode supports.

8 Claims, 1 Drawing Sheet

CURRENT COLLECTING UNIT

BACKGROUND OF THE INVENTION

The present invention relates to a current collecting unit including a current collecting rail with at least one connecting pin.

Current collecting units of the above mentioned general type are known in the art. It is known to provide a T-shaped current collecting rail with several pins and wires for connection. Both halves of the transversely located T-legs are shaped respectively to form a sleeve which receives a pin or a wire. The portions of the sleeve are bent upwardly and downwardly from the plane of the current collecting rail to form outer surrounding curves. The connection of the current collecting rail and the pin is advantageously performed by resistance welding and the parts to be welded are located upon contact with electrodes in an electrical current circuit. The electrodes simultaneously press the parts toward one another and contain a material-locking connection at least at the partial welding edges. Heat is obtained directly on the welding edges, and the temperature increase per time unit on the welding points substantially depends on the size of the contact surfaces of the electrodes on the welding material. In the known process one electrode lies on a plane surface of the current collecting rail while the other electrode lies contrary to this on the curved outer surface of the sleeve. Thereby abutment surfaces are produced which considerably differ from one another in their sizes and as a result of it the welding output can be undesirably influenced because of the resulting different heating of both welding zones. Deviations act in an especially disadvantageous manner when it is necessary to connect the materials which are difficult to weld. A list of such materials is presented in the technical journal "Wt.-Z. ind. Fertig. 71 (1981) Nr. 1" on pages 136 and 137.

SUMMARY OF THE INVENTION

Accordingly, it is an object of the present invention to provide a current collecting unit which avoids the disadvantages of the prior art.

More particularly, it is an object of the present invention to provide a current collecting unit which has the advantage in that the abutment or contact surfaces of both welding electrodes on opposite points of the sleeve or ear have approximately equal sizes.

Thereby the current concentration on these surfaces is limited with the result that the heating is substantially concentrated on these zones and a fast and uniform heating of these both zones is ensured.

The heat action is locally narrowly limited, so that the welding can be performed in immediate vicinity to the heat sensitive parts, such as semiconductors and isolation. Moreover, it is possible to work with extremely short welding times and therefore produce a very high manufacturing output.

These objects of the invention are achieved when the sleeve is provided above and below the longitudinal axis of the current collecting rail with curved portions forming abutments for the electrodes.

Because of the shape of the sleeve which surrounds the connecting pin or wire, also such material combinations which are difficult to weld can be reliably connected with one another. By the electrode pressure and the thus produced zone heating, the pin or wire are welded at both sides with the sleeve and additionally held or clamped mechanically.

A mechanically and thermally resistant construction is produced and the shape of the sleeve corresponds to the outer contour of the connecting pin.

In accordance with another feature of the present invention, the sleeve can be formed of one-piece integrally with the current collecting rail. On the other hand, it can be formed as a separate shaped part which is subsequently connected with the current connecting rail for example by point welding. The latter embodiment is especially easy to produce since it has the advantage that different materials can be used for the current collecting rail and for the sleeve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
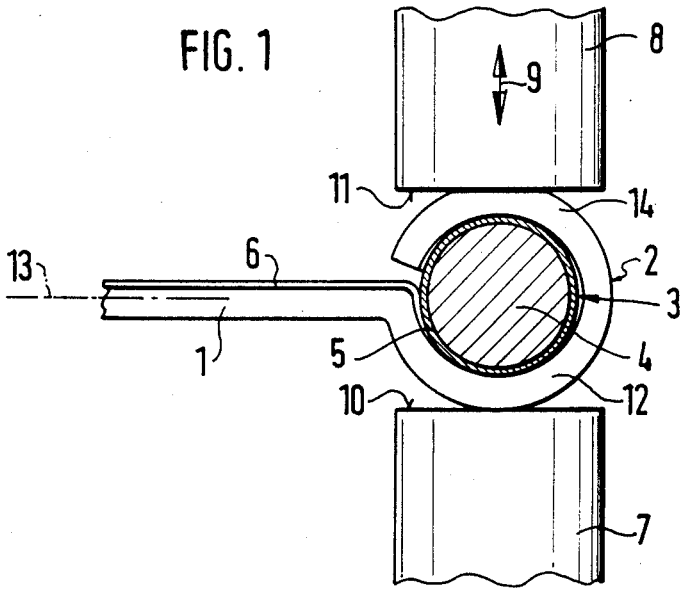
FIG. 1 is a view showing a current collecting unit with a current collecting rail and a connecting pin, on an enlarged scale.

A current collecting rail according to the present invention is identified with reference numeral 1 in FIG. 1. It is composed of an electrically conductive flat material. It is shaped on its one end by bending so as to form a sleeve 2. A connecting pin or wire 3 is mounted in the sleeve by means of resistance welding. In the shown embodiment the pin includes a core 4 with a metal coating 5 applied on the surface of the core. The metal coating is formed for example as a nickel layer. The material of the core can for example be an iron-nickel alloy which is commercially known as "KOVAR". This material is characterized by a high pressure and thermal resistance, as well as low thermal expansion.

In the shown embodiment the pin 3 has a round cross-section. The shape of the sleeve 2 corresponds to the outer contour of the pin 3. In other words it is formed ring-shaped. The inner diameter of the ring in some cases can be insignificantly smaller than the outer diameter of the pin so that the latter prior to its final mounting is fixed in the sleeve under the clamping action.

The current collecting rail 1 at least in the region of the sleeve surface which comes in contact with the pin, is provided with a coating 6 of zinc. The whole rail can be provided with a zinc coating. What is important is that the layer 6 is composed of a material with a melting point which is lower than the melting point of the material used for the current collecting rail 1 and the pin 3. The material of the current collecting rail 1 is preferably brass.

Two electrodes 7 and 8 are provided for the resistance welding. The lower electrode 7 is arranged fixedly, while the upper electrode 8 is movable in direction of the double arrow 9. The plane surfaces of the electrodes which are in contact with the welding material are identified with reference numerals 10 and 11.

As can be seen from FIG. 1, the sleeve 2 is shaped on the current collecting rail 1 so that its one half 12 is curved downwardly relative to a longitudinal axis 13 in FIG. 1, while its another half 14 is curved upwardly relative to this longitudinal axis. The surfaces 10 and 11 of the electrodes are in contact with apex lines of the sleeve halves 12 and 14, respectively. Heat and pressure of the welding electrodes 7 and 8 are concentrated during the welding process on at least approximately equally large zones of both sleeve halves 12 and 14 composed of the same material. Thereby by a pressure and current concentration on the surfaces of a definite value during the welding process is guaranteed.

The connecting pin 3 before the beginning of the welding process is inserted in the finally shaped sleeve 2. It is also possible to pre-form at least the lower half of the sleeve so as to insert the connecting pin in the thus formed convexity and then to bend the free end of the current collecting rail over the pin. Then the latter assumes the radius for the shape of the bent current collecting end. Finally, the sleeve 2 after lowering of the upper electrode is clamped between both electrode surfaces 10 and 11 and the welding current is turned on for a predetermined time. The welding parameters namely the electrode pressing force, the welding time and the welding current are adjusted in dependence upon the type and size of the used material. The heat supply must be adjusted in every case for making the zinc layer 6 melt flowable, and melt the nickel coating 5 of the connecting pin 3 as well as the edge layer of the current collecting rail 1 lying under the zinc coating 6, or bring them to a plastic phase. For this purposes the respective zones of both sleeve halves 12 and 14 are heated approximately to 800° C., and this temperature is maintained for a predetermined time. The liquid zinc is pressed in the region of the oppositely located pressure-loaded zones of the sleeve halves in the neighboring material and form together with the latter a firm bronze structure. The zinc which is located in the neighboring pressure-free regions is also melted by heat transfer and eventually fills available gaps between the inner surface of the sleeve and the outer surface of the connecting pin.

By the electrode pressing force and thereby expected material heating, the material in the region of the electrode application is compressed. During the welding process on both sleeve halves 12 and 14 flattenings are produced. In the regions of the flattenings pressure and heat are transferred to the connecting pin 3.

Figure 2:
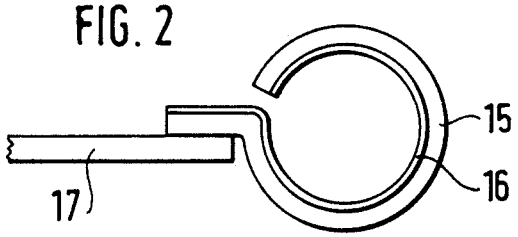
FIG. 2 is a view substantially corresponding to the view of FIG. 1, but showing the current collecting unit of the invention in accordance with another embodiment.

The embodiment shown in FIG. 2 differs from the embodiment of FIG. 1 in that the sleeve which is identified with reference numeral 15 has a zinc coating 16 and is not formed on the current collecting rail 17. Instead, it is formed as a separate shaped part which is subsequently connected with the current collecting rail 17, for example by point welding. Thereby the sleeve and the connecting pin can be welded with one another separately from the current collecting rail. Also, it is possible to make the sleeve and the current collecting rail of different materials.

Instead of the flat material, a material with other cross-sectional shapes can be used for the current collecting rail. For example, a rouhd material can be used for the current collecting rail. Also, the connecting pin can also have a different outer contour than the round contour shown in the embodiment. The shape of the sleeve or ear must correspond at least approximately to the respective outer contour of the pin.

The proposed construction of the current collecting rail is suitable especially for surface coatings and materials which are difficult to weld, when the sleeve or ear arranged on the rail surrounds the material of the connecting pin which is difficult to weld. The welding current flows through the sleeve and through the connecting pin, and the current and the electrode force are transferred to the surfaces which approximately have the same size.

It will be understood that each of the elements described above, or two or more together, may also find a useful application in other types of constructions differing from the types described above.

While the invention has been illustrated and described as embodied in a current collecting rail with at least one connecting pin, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A current collecting unit, comprising a current collecting rail having a longitudinal axis and provided with a sleeve having an inner surface; a connecting member mounted in said sleeve, said sleeve having one curved portion located above said longitudinal axis and another curved portion located below said longitudinal axis and forming electrode supports, said rail and said connecting member being formed of materials having a predetermined melting temperature; a metal coating provided on said inner surface of said sleeve and having a melting temperature which is lower than the melting temperature of said rail and said connecting member, so that during welding of said sleeve with said connecting member by applying pressure and heat said portions of said sleeve are compressed and said portions of said sleeve obtain flattenings which transfer the pressure and heat to said connecting member, and said metal coating becomes melt flowable so that available gaps between said sleeve and said connecting member are filled with said metal coating.

2. A current collecting unit as defined in claim 1, wherein said connecting member is formed as a connecting pin.

3. A current collecting unit as defined in claim 1, wherein said connecting member is formed as a connecting wire.

4. A current collecting unit as defined in claim 1, wherein said connecting member has a predetermined outer contour, said sleeve having a shape which corresponds to said outer contour.

5. A current collecting unit as defined in claim 1, wherein said current collecting rail is formed as a band composed of a zinc plated brass.

6. A current collecting unit as defined in claim 1, wherein said sleeve is formed as a shaped part which is separate from said current collecting rail and connected with the latter.

7. A current collecting unit as defined in claim 10, wherein said sleeve and said current collecting rail are formed as a one-piece integral member.

8. A current collecting unit as defined in claim 10, wherein said sleeve is formed as a shaped part which is separate from said current collecting rail and connected with the latter; and further comprising means for connecting said sleeve to said current collecting rail and including welding points.

* * * * *